US011073355B1

(12) United States Patent
Flores, Jr.

(10) Patent No.: US 11,073,355 B1
(45) Date of Patent: Jul. 27, 2021

(54) PULLEY SYSTEM AND METHOD OF USE

(71) Applicant: Rodolfo Flores, Jr., Dallas, TX (US)

(72) Inventor: Rodolfo Flores, Jr., Dallas, TX (US)

( * ) Notice: Subject to any disclaimer, the term of this patent is extended or adjusted under 35 U.S.C. 154(b) by 0 days.

(21) Appl. No.: 16/687,993

(22) Filed: Nov. 19, 2019

Related U.S. Application Data

(60) Provisional application No. 62/769,274, filed on Nov. 19, 2018.

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105; Y10S 124/90
USPC ..... 124/25.6, 900
See application file for complete search history.

(56) References Cited

U.S. PATENT DOCUMENTS 4,294,221 A * 10/1981 Bryant ..... F41B 5/105 124/25.6
4,757,799 A * 7/1988 Bozek ..... F41B 5/10 124/25.6
4,887,582 A * 12/1989 Chattin ..... F41B 5/10 124/25.6
5,054,462 A * 10/1991 Larson ..... F41B 5/105 124/25.6
5,092,309 A * 3/1992 Beaton ..... F41B 5/10 124/25.6
5,975,067 A * 11/1999 Strother ..... F41B 5/10 124/25.6
6,032,660 A * 3/2000 Hervig ..... F41B 5/10 124/25.6
6,516,790 B1 * 2/2003 Darlington ..... F41B 5/10 124/25.6
6,994,079 B1 * 2/2006 Darlington ..... F41B 5/10 124/25.6
7,673,626 B1 * 3/2010 Hennings ..... F41B 5/105 124/25.6
8,469,013 B1 * 6/2013 Obteshka ..... F41B 5/105 124/25.6
10,641,577 B1 * 5/2020 Archer ..... F41B 5/1403
2012/0222663 A1 * 9/2012 Nebergall ..... F41B 5/10 124/25.6

* cited by examiner

*Primary Examiner* — Alexander R Niconovich
(74) *Attorney, Agent, or Firm* — Leavitt Eldredge Law Firm

(57) ABSTRACT

A compound bow system includes a compound bow with a bow string; a first pulley engaged with the bow string; a cam attachment having a smaller diameter than the first pulley and positioned on a front surface of the first pulley; and a trigger attached to the front surface of the first pulley; the first pulley and cam attachment are connected via the trigger; and the first pulley is so that when the trigger is engaged, the cam attachment holds a force.

4 Claims, 4 Drawing Sheets

PULLEY SYSTEM AND METHOD OF USE

BACKGROUND

1. Field of the Invention

The present invention relates generally to a coupled pulley system and methods of use. More specifically, the invention is related to a system and method to trigger a release mechanism via a coupled pulley system.

2. Description of Related Art

Systems and methods for release mechanisms for compound bows are well known in the art. As shown in FIG. 1, a conventional compound bow 101 is comprised of a main riser 103 from which a top 107 and bottom limb 109 extend away from the riser. At the other end of each limb, a cam 111, 113 is attached via an axle point 115, 117. A cam acts as a pulley. A hand grip 105 is located in the middle of the riser. Additionally, there is a center string 119 whose length runs vertically from the top cam to the bottom cam. A cable control string 121 is also connected to the top and bottom cams but is crossed to as to make an X next to the center string, the bow further having a central string support 127. A conventional compound bow makes use of the top and bottom cam connected via a bow string and bow cables to be able to launch an arrow with more force than a traditional bow and arrow configuration that does not engage a pulley system. This is shown in FIG. 1 as system 101. In FIG. 2, system 201 depicts the cam 111 engaged with center string 119, cable control string 121 about axel point 115.

One of the problems commonly associated with the conventional system is the limited use. For example, often times it is extremely difficult to engage the bow string into a fully extended position. Without a fully extended position, it is difficult to create sufficient force to properly launch an arrow.

Although great strides have been made in the area of compound bow systems and methods of use, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
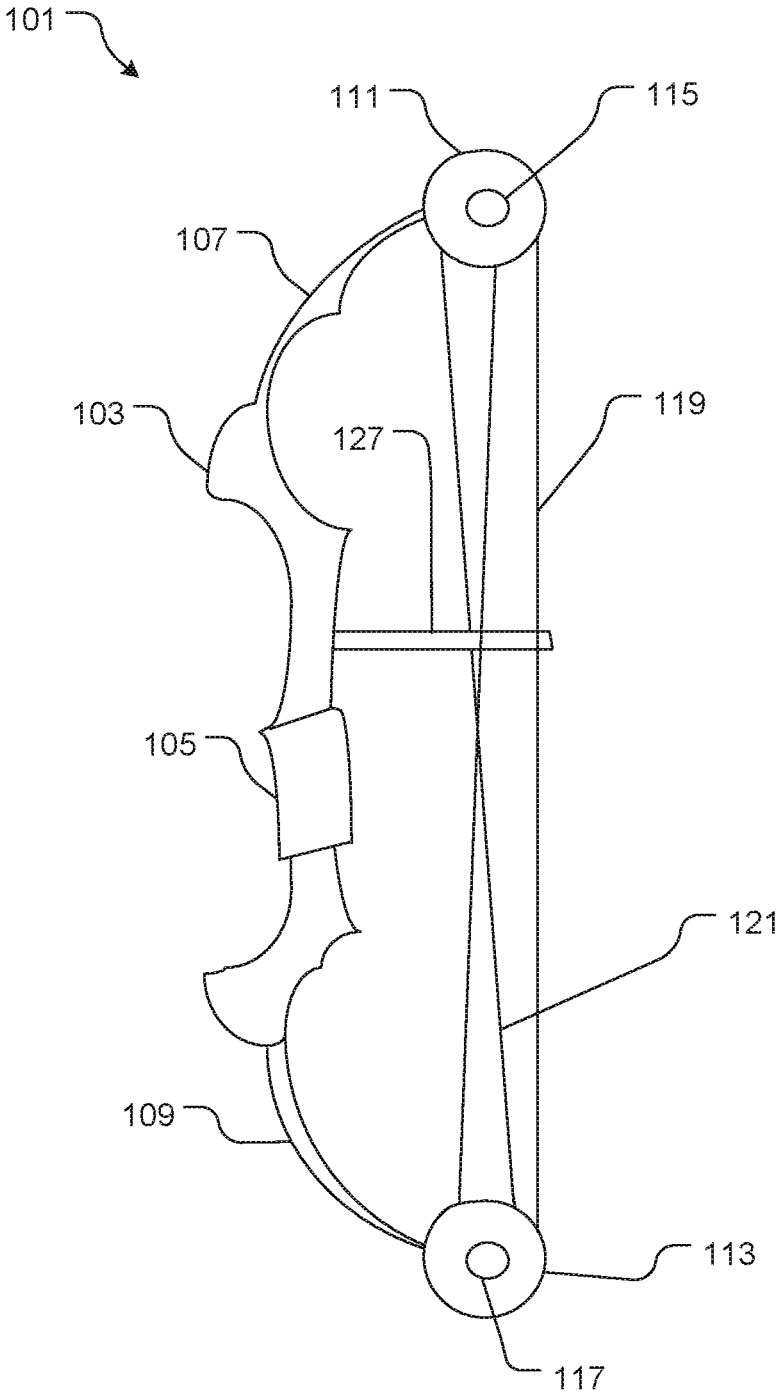
FIG. 1 (Prior Art)
FIG. 1 is a side view of a conventional compound bow.
Figure 2:
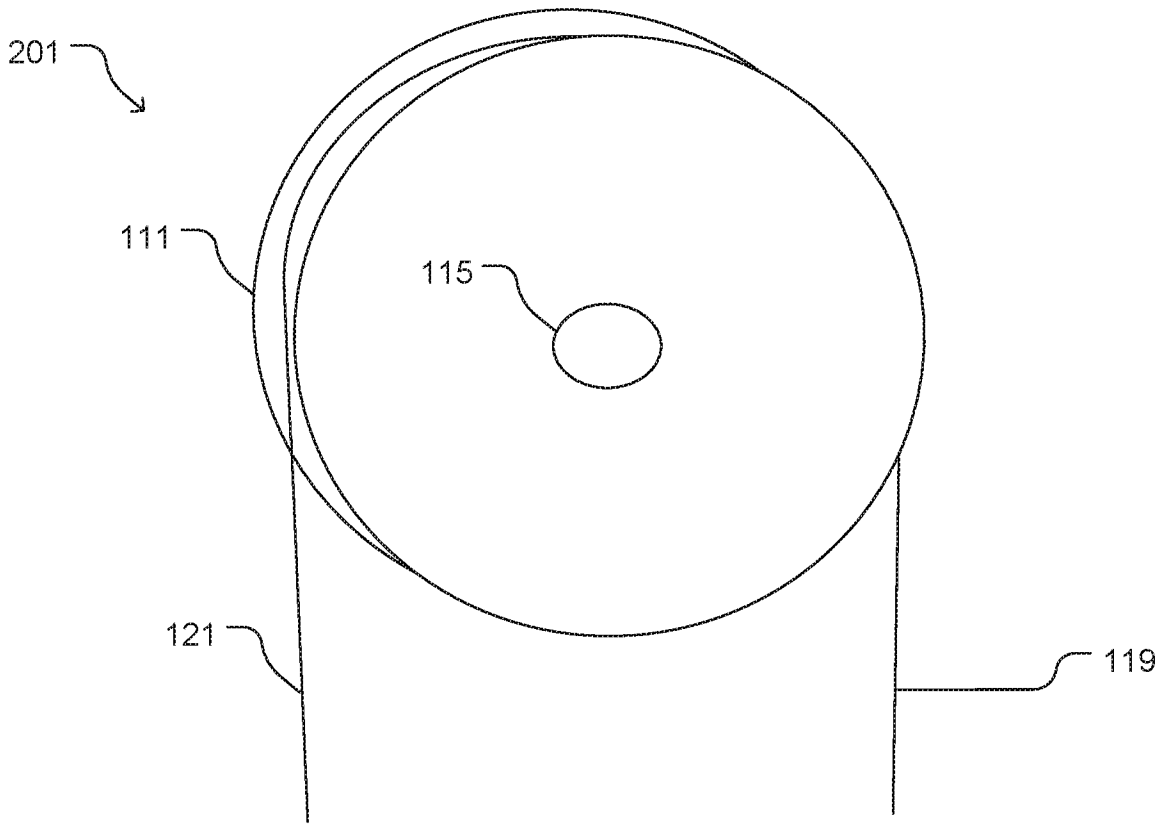
FIG. 2 (Prior Art)
FIG. 2 is a side view of a cam configuration of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems and methods of using a compound bow pulley system.

Specifically, the present invention is directed to a compound bow pulley system that is configured to decrease the effective diameter of the cam to allow for easier arrow loading and release. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 3B:
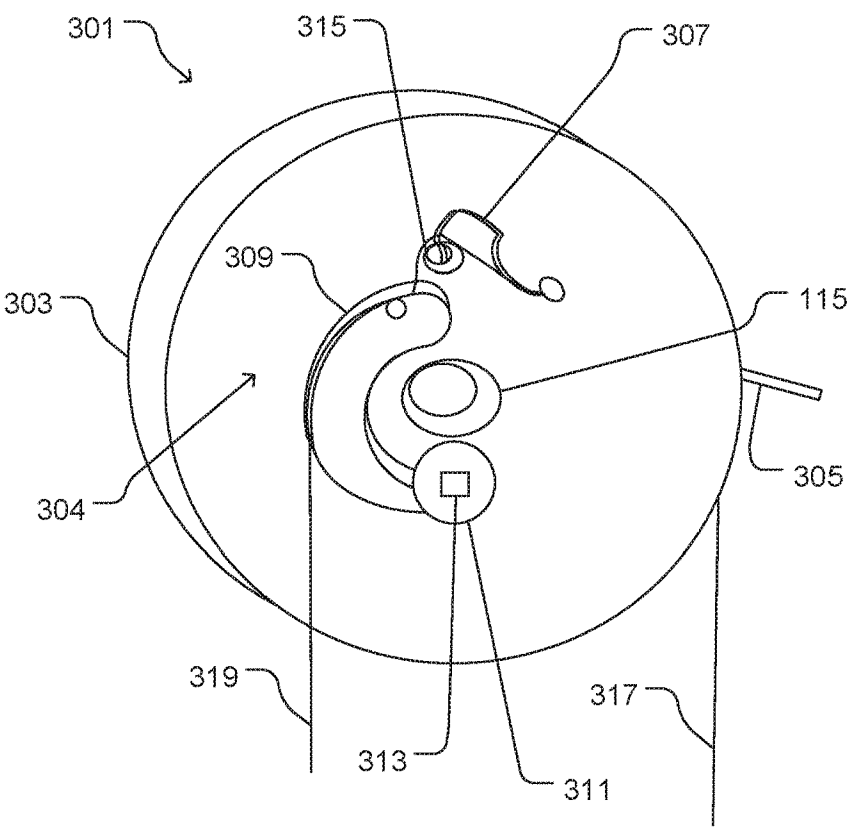
FIGS. 3*a* and 3*b* are side views of pulley system in accordance with the present application.
Figure 3A:
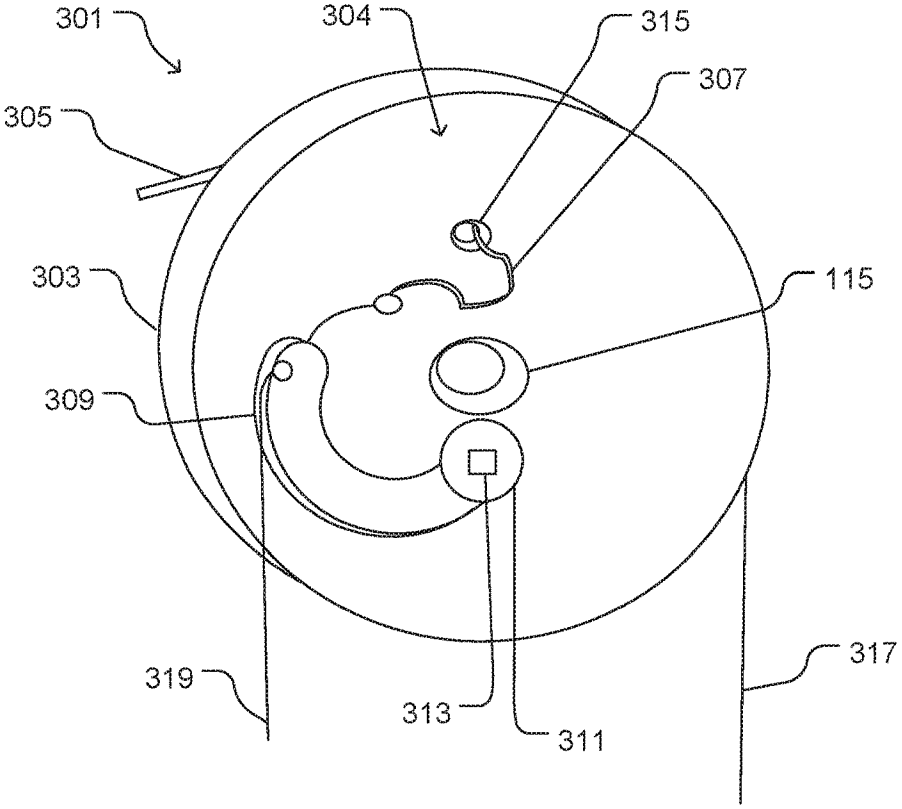

Referring now to the drawings wherein like reference characters identify corresponding or similar elements throughout the several views, FIGS. 3*a* and 3*b* depict various views of a system 301 and method of use in accordance with a preferred embodiment of the present application. It will be appreciated that system 301 overcomes one or more of the above-listed problems commonly associated with the conventional systems and methods to deliver packages.

In the contemplated embodiment, system 301 includes one or more of the same features as the system 201; however, it is contemplated utilizing a circular cam 303 with a cam attachment 309 that allows the user to decrease the effective diameter of the cam and is configured to overcome the problems commonly associated with conventional delivering processes.

Referring now to FIGS. 3*a* and 3*b*, various views of the present invention are shown. The cam system 301 is shown having a circular cam with a certain diameter and width, creating a cylindrical shape. The cam system 301 is configured so as to attach to the limb 107,109 of a compound bow via an axle point 115,117. The circumferential edge of the cam is beveled such that a depressed groove is created for the string 317 to rest and slide during the loading and release of an arrow.

On the front surface 304 of the cam 303, a small aperture 315 is configured to allow a trigger arm 307 to feed through the aperture 315. The trigger arm 307 is connected to a semicircular cam attachment 309 that protrudes from the front surface 304 of the cam 303 via the cable control string 319. The semicircular cam attachment 309 is configured with a specific diameter and width, with the outer circumferential edge of the cam attachment 309 beveled in the same manner as the cam 303 to allow for the cable control string 319 to rest and slide.

In this embodiment, one end of the cable control string 319 is tied onto a first end of the trigger arm 307. The cable control string 319 is then fed around the outer circumferential edge of the cam attachment 309. A second end of the trigger arm 307 is fed through the aperture 315 and attached to the lever 305 which controls the position of the trigger arm 307 and the position of the cam attachment 309. The trigger arm 307 is configured so as to be able to rotate upward towards the top of the cam 303.

The semicircular cam attachment 309 is attached to the front surface 304 of the cam 303 via a washer and bolt that allows the cam attachment to rotate in the same direction as the trigger arm 307. Referring to FIG. 3*a*, the cam is shown in the unlocked position, with the lever 305 extending perpendicular to the vertical center string 317. In this unlocked position, the semicircular cam attachment 309, is positioned so as to allow the cable control string 319 to be pulled around the same diameter length as the cam 303.

Referring to FIG. 3*b*, the position of the cam attachment 309 can be shifted inward by pulling up on the lever 305, which in turn rotates the trigger arm 307. The trigger arm 307 then pulls the cable control string 319 and the cam attachment 309 inward. Now, when the center string 317 is pulled away from the riser 103, the cable control string 319 is pulled from the new decreased diameter length created by the cam attachment in the loaded position as shown in FIG. 3*b*. Thus, the cam 303 and the cam attachment 309 create a coupled pulley system in which the user can adjust the effective diameter of the pulley system or cam system 301.

This is an important advantage in the system of compound bow cams because it allows the user to load an arrow and fully extend the center string away from the riser with considerably less effort while maintaining the same force applied to the arrow upon release.

In one contemplated embodiment, the cam 303 and cam attachment 309 could be composed of a rigid material like a carbon fiber composite or other strong, light-weight material.

It is anticipated that the present invention may be configured to be used within many different compound bow configurations. Additionally, it is anticipated that the coupled pulley system incorporating a way to decrease the effective diameter of the original pulley could be used in any system requiring a heavy load to be pulled or lifted via a string and pully system.

Figure 4:
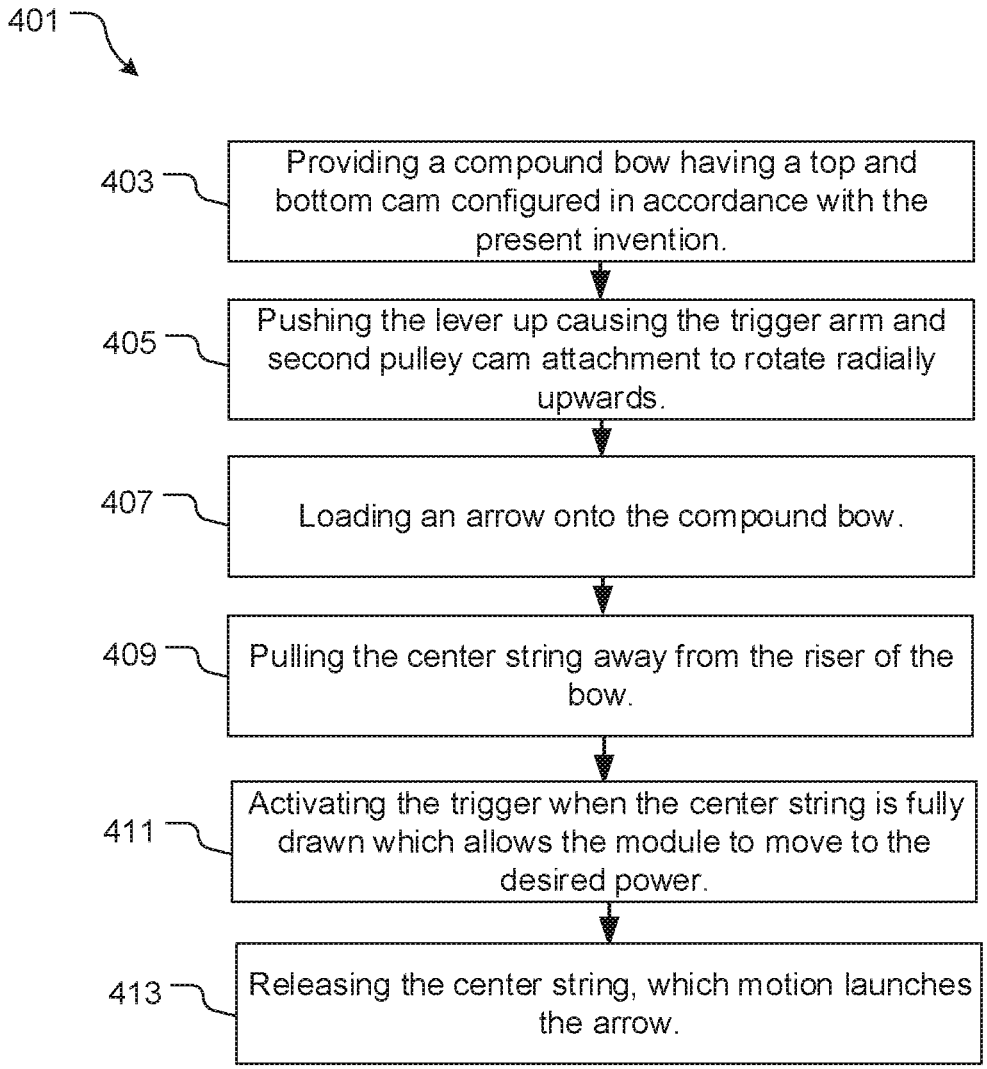
FIG. 4 is a flowchart of the method of use of the system of FIGS. 3*a* and 3*b*.

In FIG. 4, a flowchart 401 depicts the preferred method of use as shown in boxes 401-411. The method includes providing a compound bow configured with a cam system 301 as discussed above. The user pushes the lever up, rotating the trigger arm and cam attachment to its loaded position thus decreasing effective diameter of the cam system. An arrow is loaded onto the compound bow and the center string is pulled to extend it from the riser. The center string is then released, launching the arrow into the air.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

The invention claimed is:

1. A coupled pulley system comprising:

a first pulley having a front surface;

an aperture extending through a thickness of the first pulley and open to the front surface;

a cam attachment having a smaller diameter than the first pulley and positioned on the front surface of the first pulley; and a trigger attached to the front surface of the first pulley and partially extending through the aperture; and a lever protruding from the first pulley, wherein the lever is connected to the trigger and configured so that when the lever is pulled down, the trigger is activated and causes the cam attachment to rotate upwards;

wherein the first pulley and cam attachment are connected via the trigger, wherein the first pulley is configured so that when the trigger is engaged, the cam attachment holds a force.

2. The system of claim 1, wherein the cam attachment comprises:

a semicircular shape attached to the front surface of the first pulley, wherein the cam attachment is configured to be able to rotate upwards in a circular movement when the trigger is activated.

3. The system of claim 1, wherein the front surface of the first pulley further comprises a small aperture configured to allow a trigger arm to feed therethrough.

4. The system of claim 1, further comprising:

a cable control string engaged with a trigger arm.

* * * * *